US012370398B1

(12) United States Patent
Yu

(10) Patent No.: US 12,370,398 B1
(45) Date of Patent: Jul. 29, 2025

(54) DUAL AXIS ADJUSTABLE DUMBBELL AND DUMBBELL KIT

(71) Applicant: Zhejiang Zuojian Industry and Trade Co., Ltd., Jinhua (CN)

(72) Inventor: Zhaohong Yu, Yongkang (CN)

(73) Assignee: Zhejiang Zuojian Industry and Trade Co., Ltd., Jinhua (CN)

( * ) Notice: Subject to any disclaimer, the term of this patent is extended or adjusted under 35 U.S.C. 154(b) by 0 days.

(21) Appl. No.: 19/055,148

(22) Filed: Feb. 17, 2025

(30) Foreign Application Priority Data

Feb. 7, 2025 (CN) ..... 202520190001.0

(51) Int. Cl.
*A63B 21/075* (2006.01)
*A63B 21/072* (2006.01)
*A63B 71/00* (2006.01)

(52) U.S. Cl.
CPC ..... *A63B 21/075* (2013.01); *A63B 21/0726* (2013.01); *A63B 21/0728* (2013.01); *A63B 71/0036* (2013.01)

(58) Field of Classification Search
CPC ..... A63B 21/075; A63B 21/0726; A63B 21/7028
See application file for complete search history.

(56) References Cited

U.S. PATENT DOCUMENTS 6,500,101 B1 * 12/2002 Chen ..... A63B 21/072 482/107
8,025,613 B1 * 9/2011 Wang ..... A63B 71/06 482/107
12,246,207 B1 * 3/2025 Yu ..... A63B 21/0726
2004/0005968 A1 * 1/2004 Crawford ..... A63B 21/0607 482/106
2018/0264308 A1 * 9/2018 Wang ..... A63B 21/075
2019/0168059 A1 * 6/2019 Svenberg ..... A63B 21/0726
2020/0398100 A1 * 12/2020 Wang ..... A63B 21/0726
2022/0152443 A1 * 5/2022 Casagrande ..... A63B 21/0728
2023/0031956 A1 * 2/2023 Luo ..... A63B 21/0726
2023/0052772 A1 * 2/2023 Wang ..... A63B 71/0036
2023/0173327 A1 * 6/2023 Wang ..... A63B 21/075 482/107
2023/0271050 A1 * 8/2023 Tong ..... A63B 21/0728 482/108
2023/0285794 A1 * 9/2023 Zhou ..... A63B 21/0724
2024/0198166 A1 * 6/2024 Wang ..... A63B 21/0726
2025/0058164 A1 * 2/2025 Zhang ..... A63B 21/0726

* cited by examiner

*Primary Examiner* — Joshua T Kennedy
(74) *Attorney, Agent, or Firm* — JEEN IP LAW, LLC

(57) ABSTRACT

A dumbbell and a dumbbell kit are provided, the dumbbell includes a dumbbell body, dumbbell pieces accumulatively installed at two ends of the dumbbell body, and adjustment mechanisms respectively provided at two ends of the dumbbell body; the dumbbell body includes a grip rod, a center rod rotatably provided at a center position of the grip rod, and two sets of shell components respectively provided at two ends of the grip rod; the shell components include a main body shell fixedly connected to the center rod and one or more adjustable shells, the adjustable shells are fixedly connected to the center rod; the number of dumbbell pieces corresponds to the number of the adjustable shells, and the dumbbell pieces are provided with dumbbell holes that run through the dumbbell pieces. The dumbbell has the effect of improving the weight adjustment efficiency of dumbbells.

9 Claims, 8 Drawing Sheets

DUAL AXIS ADJUSTABLE DUMBBELL AND DUMBBELL KIT

CROSS-REFERENCE TO RELATED APPLICATIONS

This application claims priority to Chinese Patent Application No. 2025201900010, filed on Feb. 7, 2025, which is hereby incorporated by reference in its entirety.

TECHNICAL FIELD

The present disclosure relates to the field of dumbbell technologies, and in particular, to an adjustable dumbbell and a dumbbell kit.

BACKGROUND

Dumbbells are widely used as fitness equipment, especially those that can easily adjust weight, which are favored by many fitness enthusiasts. A user needs to frequently adjust different weights or numbers of dumbbell pieces to achieve various weight adjustments.

At present, the commonly used weight adjustable dumbbell consists of a dumbbell rod, a plurality of detachable bell pads, and two spring clamps (or nuts); when adjusting the weight, the spring sleeves at two ends are first removed, then the dumbbell pieces are added or removed, and finally the spring sleeves are installed.

Regarding the relevant technologies mentioned above, although weight adjustable dumbbells achieve weight adjustment, manually disassembling and adjusting the dumbbell pieces to adjust the weight is laborious and requires manual calculation of an adjusted weight, resulting in low efficiency in adjusting the weight of the dumbbells. It is difficult to adjust the weight of the dumbbells frequently, which affects the exercise effect of using the dumbbells.

SUMMARY

In order to improve the weight adjustment efficiency of the dumbbells, the present disclosure provides an adjustable dumbbell and a dumbbell kit.

The adjustable dumbbell and the dumbbell kit provided in this disclosure adopt the following technical solution.

An adjustable dumbbell, including a dumbbell body, where the dumbbell body includes a grip rod, a center rod provided at a center position of the grip rod, two sets of shell components respectively provided at two ends of the grip rod, and one or more adjustable shells fixedly connected to the center rod, where the shell components include a main body shell that is fixedly connected to the center rod;

dumbbell pieces that are accumulatively installed at two ends of the dumbbell body, the dumbbell pieces correspond to the number of the adjustable shells, and the dumbbell pieces are provided with dumbbell holes that are penetrated; and adjustment mechanisms that are respectively provided at two ends of the dumbbell body, where the grip rod is rotated relative to the central rod, the adjustment mechanisms include one or more sets of adjustment components and one or more fixed rods; the number of the adjustment components corresponds to the number of adjustable shells, each set of the adjustment components is respectively provided in each of the adjustable shells, the adjustment components include an adjustment slider, the adjustment slider is slid radially and fit inside the adjustable shells, the fixed rod is slid axially and fit inside the adjustable shells, where the fixed rod is in contact and fitted with the adjustment slider;

when the adjustment slider is slid in a direction close to the fixed rod, the fixed rod is slid in a direction close to the dumbbell pieces and pass through the dumbbell holes, so that the dumbbell pieces are accumulated on the dumbbell body.

By adopting the above technical solution, when adjusting the weight of the dumbbell, the grip rod is rotated to render the grip rod to be rotated relative to the center rod, thereby driving the adjustment mechanism and driving each adjustment component. This causes a part of the adjustment slider to slide towards a direction of the fixed rod, thereby pushing the fixed rod to pass through the dumbbell hole and accumulating the corresponding dumbbell pieces to the dumbbell body. This causes another part of the adjustment slider to slide away from the direction of the fixed rod, thereby causing the fixed rod to detach from the dumbbell hole and allowing the dumbbell pieces to detach from the dumbbell body, thus quickly completing the weight adjustment of the adjustable dumbbell. Although the weight adjustment of the dumbbell is achieved, manually disassembling and adding or removing the dumbbell pieces to adjust the weight is laborious and requires manual calculation of the adjusted weight. This further leads to low efficiency in adjusting the weight of the dumbbells, rendering it difficult to frequently adjust the weight of the dumbbells, thereby affecting the exercise effectiveness of using the dumbbells.

In an embodiment of the present disclosure, the adjustment mechanisms further include a driving component; the driving component includes a first driving shaft, the first driving shaft includes one or more first shaft body parts, the first driving shaft is composed of the first shaft body parts that are connected end-to-end, the number of the first shaft body parts corresponds to the number of the adjustable shells, and the first shaft body parts are rotatably provided on the adjustable shells;

one or more first adjustment blocks are fixedly provided on an outer peripheral surface of each of the first shaft body parts, number and position of the first adjustment blocks provided on the outer peripheral surface of each of the first shaft body parts are different;

the adjustment slider is fixedly provided with a first abutting block configured to abut against the first adjustment block; when the adjustment slider is slid in a direction close to the fixed rod, any of the first adjustment blocks is rotated to abut against the first abutting block.

In an embodiment of the present disclosure, the driving component further includes a second driving shaft, the second driving shaft includes one or more second shaft body parts, the second driving shaft is composed of the second shaft body parts that are connected end-to-end, number of the second shaft body parts corresponds to the number of the adjustable shells, and the second shaft body parts are rotatably provided in the adjustable shells;

one or more second adjustment blocks are fixedly provided on an outer peripheral surface of each of the second shaft body parts; number and position of the second adjustment blocks provided on the outer peripheral surface of each of the second shaft body parts are different;

the first shaft body part and the second shaft body part are provided in the same adjustable shells, the number of the first adjustment blocks provided on the first shaft body part and the number of the second adjustment blocks provided on the second shaft body part are different, and the position of the first adjustment block provided on the first shaft body part and the position of the second adjustment block provided on the second shaft body part are different;

the adjustment slider is provided with an adjustment hole that runs through the adjustment slider, the second shaft body part is penetrated through the adjustment hole, and a hole wall of the adjustment hole is fixedly provided with a second abutting block configured to abut against the second adjustment block;

when the adjustment slider is slid towards the fixed rod, any of the first adjustment blocks is rotated to abut against the first abutting block, or any of the second adjustment blocks is rotated to abut against the second abutting block.

In an embodiment of the present disclosure, the adjustment mechanism further includes a linkage component, where the linkage component includes a driving gear and a driven gear, the driving gear is coaxially and fixedly connected to the grip rod and is coaxially fixed with the second driving shaft;

the driven gear is fixed coaxially with the first drive shaft;

the driving gear meshes with the driven gear.

In an embodiment of the present disclosure, the adjusting component further includes a reset spring and a fixed spring, one end of the reset spring is connected to the adjustable shells and the other end of the reset spring is connected to the adjustment slider;

the number of the fixed spring corresponds to the number of the fixed rod, one end of the fixed spring is connected to the adjustable shells and the other end of the fixed spring is connected to the fixed rod.

In an embodiment of the present disclosure, the adjustment mechanism further includes a shifting component, one or more shift balls, and a shift spring; the shifting component includes a shifting wheel, the shifting wheel is rotatably provided on the main body shell and fixed coaxially with the grip rod;

the shifting wheel is provided with a plurality of shifting holes that are penetrated, the shifting holes are uniformly distributed around an axis of the shifting wheel in a circumferential direction;

the shift ball is slid along an axial direction, cooperated with the adjustable shells and is configured to engage with any shifting hole;

the number of the shift spring corresponds to the number of the shift ball, one end of the shift spring is connected to the adjustable shells and the other end of the shift spring is connected to the shift ball;

when adjusting the weight of the dumbbell, the shift ball is disengaged from one shifting hole and passes through another shifting hole.

In an embodiment of the present disclosure, the shifting component further includes a scale wheel, the scale wheel is rotatably provided on the main body shell and fixed coaxially with the grip rod;

an outer peripheral surface of the scale wheel is provided with a plurality of weight scales, the weight scales are uniformly distributed around an axis of the scale wheel in a circumferential direction;

the main body shell is provided with a weight hole that is penetrated, and a weight scale directly opposite the weight hole is the weight of the adjustable dumbbell.

In an embodiment of the present disclosure, the adjustment mechanism further includes a locking component, a locking spring, a safety slider, and a safety spring; the locking component includes a locking slider, the locking slider is slid radially and fitted with the main body shell, the shifting wheel is provided with a plurality of locking grooves configured to clamp and fix with the locking slider, when the locking component is locked, the locking slider is inserted, clamped and fixed in any locking groove;

one end of the locking spring is connected to the locking slider, and the other end of the locking spring is connected to the main body shell;

the safety slider is slid along an axial direction and fitted with the main body shell; the safety slider is fixedly connected to one or more first safety blocks in a radial direction;

the scale wheel is provided with a plurality of safety slots configured to clamp and fix with the first safety block; the safety slider is fixedly connected to a second safety block along the axial direction;

when the locking component is locked, the first safety block is inserted, clamped and fixed in any of the safety slots;

one end of the safety spring is connected to the safety slider and the other end of the safety spring is connected to the main body shell.

A dumbbell kit including the adjustable dumbbell and a dumbbell seat configured to place the adjustable dumbbell, where the dumbbell seat is provided with a placement groove configured to place the adjustable dumbbell, the placement groove is provided with two unlocking blocks configured to unlock a locking component; when the adjustable dumbbell is placed on the dumbbell seat, the two unlocking blocks are respectively abutted against two locking sliders, and push the locking sliders to disengage from locking grooves to achieve an unlocking of the locking component.

In an embodiment of the present disclosure, the unlocking blocks are provided with a safety hole that is cooperated with a second safety block, and when the locking sliders face a position between two adjacent locking grooves, the second safety block is inserted into the safety hole, then the adjustable dumbbell is connected to the dumbbell seat until the locking sliders are directly facing any of the locking grooves, when the second safety block is disengaged from the safety hole, the adjustable dumbbell is disconnected from the dumbbell seat.

In summary, the present disclosure includes at least one beneficial technical effect as follows.

When adjusting the weight of the dumbbell, the grip rod is rotated to render the grip rod to be rotated relative to the center rod, thereby driving the adjustment mechanism and driving each adjustment component. This causes a part of the adjustment slider to slide towards the direction of the fixed rod, pushing the fixed rod to pass through the dumbbell hole and accumulating the corresponding dumbbell pieces on the dumbbell body. This causes another part of the adjustment slider to slide away from the direction of the fixed rod, thereby causing the fixed rod to detach from the dumbbell hole and allowing the dumbbell pieces to be detached from the dumbbell body, thus quickly completing the weight adjustment of the adjustable dumbbell. Although the weight adjustment of the dumbbell is achieved, manually disassembling and adding or removing the dumbbell pieces to adjust the weight is laborious and requires manual calculation of the adjusted weight. This further leads to low efficiency in adjusting the weight of the dumbbells, rendering it difficult to frequently adjust the weight of the dumbbells, thereby affecting the exercise effectiveness of using the dumbbells.

Numeral reference: 1—dumbbell body; 11—grip rod; 111—rubber sleeve; 12—center rod; 13—shell component; 131—main body shell; 1311—weight hole; 132—adjustable shell; 133—bottom shell; 134—connection rod; 135—protective cover; 2—dumbbell piece; 3—adjustment mechanism; 31—adjustment component; 311—adjustment slider; 3111—adjustment part; 3112—inclined part; 3113—first abutting block; 3114—adjustment hole; 3115—second abutting block; 312—reset spring; 313—fixed rod; 314—fixed spring; 32—driving component; 321—first driving shaft; 3211—first shaft body part; 32111—first adjustment block; 322—second driving shaft; 3221—second shaft body part; 32211—second adjustment block; 33—linkage component; 331—driving gear; 332—driven gear; 34—shifting component; 341—shifting wheel; 3411—shifting hole; 3412—locking groove; 342—shift ball; 343—shift spring; 344—scale wheel; 3441—safety slot; 35—locking component; 351—locking slider; 352—locking spring; 353—safety slider; 3531—first safety block; 3532—second safety block 354—safety spring; 10—adjustable dumbbell; 20—dumbbell seat; 201—placement groove; 202—unlocking block; 2021—safety hole.

DESCRIPTION OF EMBODIMENTS

Further detailed explanation of the present disclosure will be provided in combination with FIGS. 1-9.

Figure 1:
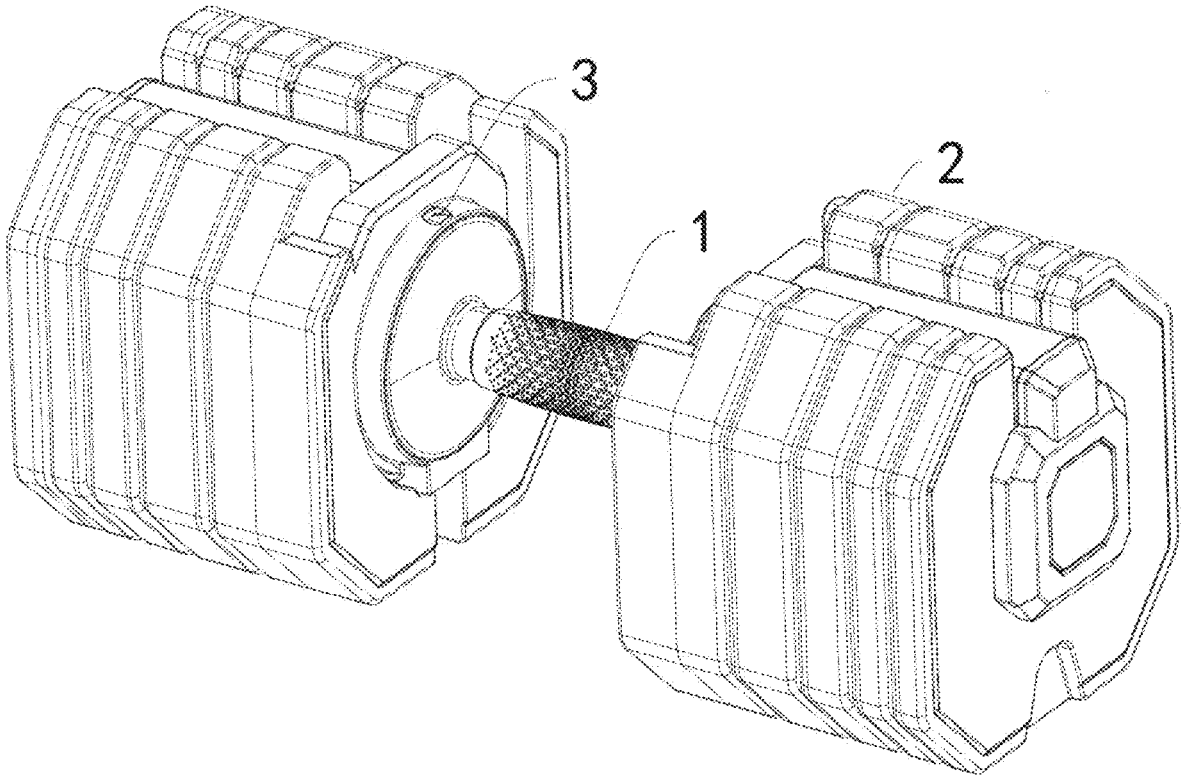
FIG. 1 is a schematic diagram of an overall structure of an embodiment of the present disclosure.

The present disclosure discloses an adjustable dumbbell and a dumbbell kit. Referring to FIG. 1, the adjustable dumbbell includes a dumbbell body 1, a plurality of dumbbell pieces 2, and two sets of adjustment mechanisms 3. Each of the dumbbell pieces 2 is cumulatively installed on the dumbbell body 1. Different numbers and weights of dumbbell pieces 2 are added to the dumbbell body 1 so as to change the overall weight of the adjustable dumbbell. The two sets of adjustment mechanisms 3 are respectively provided at two ends of the dumbbell body 1 and configured to adjust the number and weight of the dumbbell pieces 2 accumulated on the two ends of the dumbbell body 1.

Figure 2:
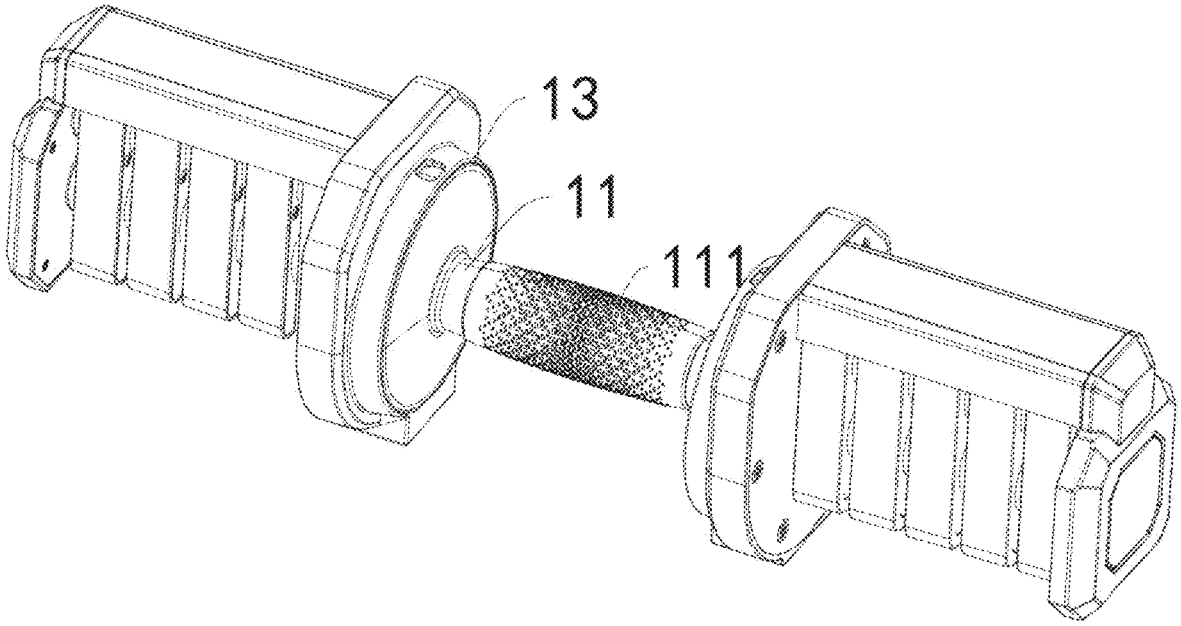
FIG. 2 is a schematic diagram of a main structure of a dumbbell in an embodiment of the present disclosure.
Figure 3:
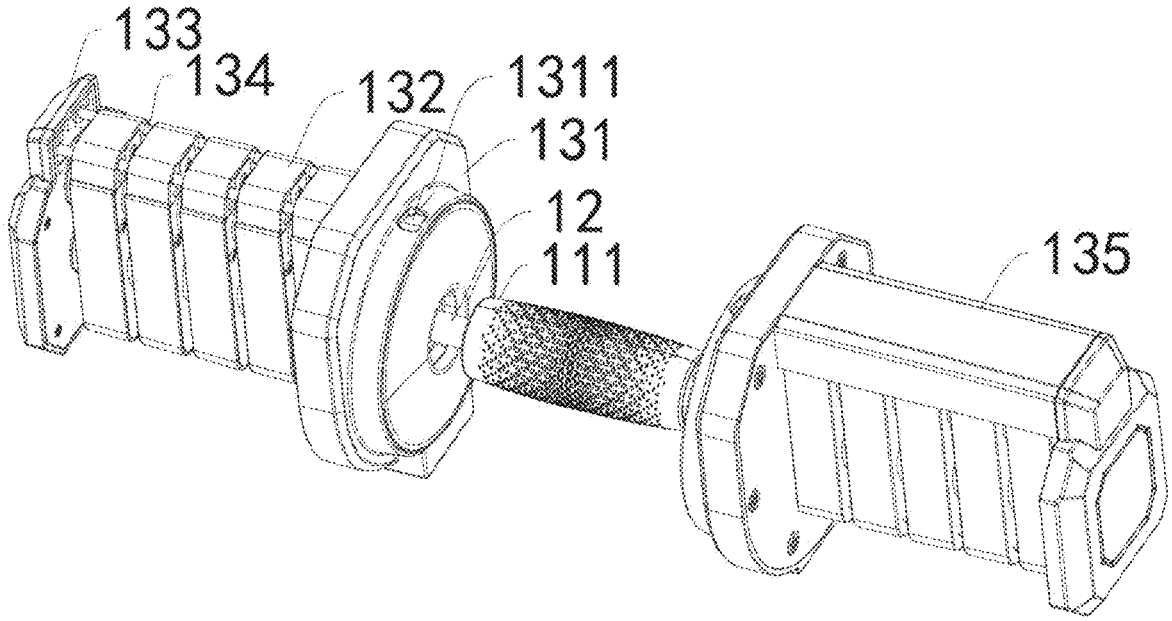
FIG. 3 is a schematic structural diagram of a shell component in an embodiment of the present disclosure.

Referring to FIGS. 2 and 3, the dumbbell body 1 includes a grip rod 11, a center rod 12, and two sets of shell components 13. The center rod 12 is connected to a center position of the grip rod 11 and can be rotated relative to the grip rod 11. A rubber sleeve 111 is fixedly connected to an outer peripheral surface of the grip rod 11 to increase a surface friction resistance of the grip rod 11. The two sets of shell components 13 are respectively provided at the two ends of the grip rod 11.

Referring to FIGS. 2 and 3, the shell component 13 includes a main body shell 131, and the main body shell 131 is rotatably provided at one end of the grip rod 11. A cross-section of the main body shell 131 is circular. In this embodiment, an axis direction of the central rod 12 is an axial direction, and a radial direction of the main body shell 131 is a radial direction.

Referring to FIGS. 2 and 3, the shell component 13 further includes a plurality of adjustable shells 132, the adjustable shells 132 are rotatably provided on the grip rod 11 and evenly distributed along one end of the grip rod 11. A cross-section of each of the adjustable shells 132 is rectangular.

Referring to FIGS. 2 and 3, the shell component 13 further includes a bottom shell 133, two connection rods 134, and a protective cover 135. The bottom shell 133 is fixedly provided at one end of the central rod 12, the two connection rods 134 are fixedly connected to the bottom shell 133. The main body shell 131 is fixedly connected to one end of the two connection rods 134 away from the bottom shell 133, so that the main body shell 131 is fixedly connected to the central rod 12. Each of the adjustable shells 132 is fixedly connected to the two connection rods 134, so that each of the adjustable shells 132 is fixed to the central rod 12, one end of the protective cover 135 is fixedly connected to the bottom shell 133, and the other end of the protective cover 135 is fixedly connected to the main body shell 131, and the two connection rods 134 and each of the adjustable shells 132 are covered together.

Referring to FIG. 1, the number of the dumbbell pieces 2 corresponds to the number of the adjustable shells 132. Each of the dumbbell pieces 2 is provided with two dumbbell holes that are penetrated. When the dumbbell pieces 2 are cumulatively installed on the dumbbell body 1, the two dumbbell holes of the dumbbell pieces 2 are directly aligned with one adjustable shell 132.

Figure 4:
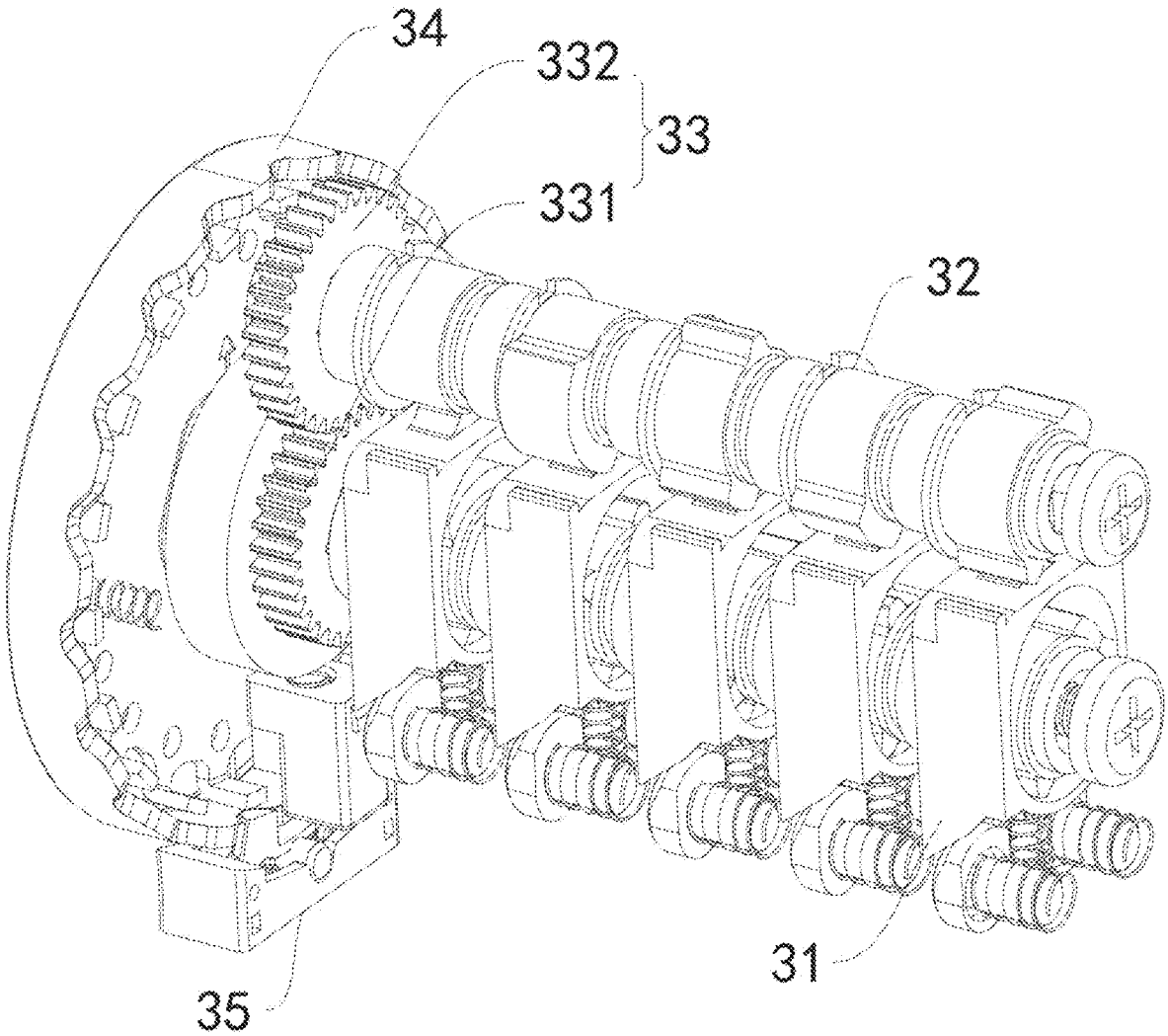
FIG. 4 is a schematic structural diagram of an adjustment mechanism in an embodiment of the present disclosure.
Figure 5:
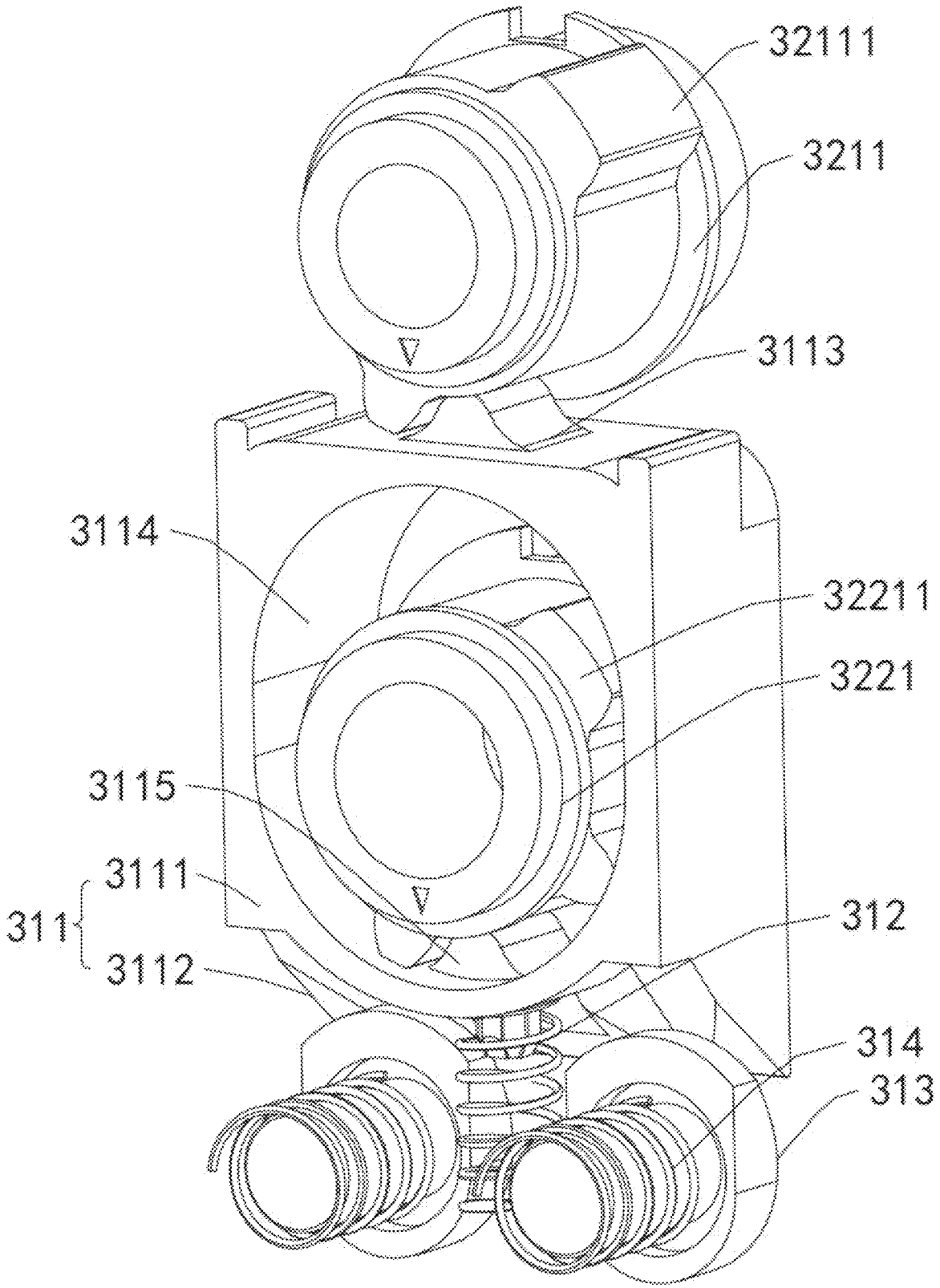
FIG. 5 is a schematic structural diagram of the adjustment component in the embodiment of the present disclosure.

Referring to FIGS. 4 and 5, the adjustment mechanism 3 includes a plurality of sets of adjustment components 31, the number of adjustment components 31 corresponds to the number of the adjustable shells 132. Each of the adjustment components 31 is respectively provided on each of the adjustable shells 132. The adjustment component 31 includes an adjustment slider 311 and a reset spring 312. The adjustment slider 311 slides radially and is fitted inside the adjustable shells 132. The adjustment slider 311 includes an adjustment part 3111 and an inclined part 3112. The inclined part 3112 is fixedly provided at one end of the adjustment part 3111 near the center rod 12, a thickness of the inclined part 3112 is gradually decreased from near the adjustment part 3111 towards a direction away from the adjustment part 3111. The reset spring 312 is located between the adjustment part 3111 and the adjustable shells 132, one end of the reset spring 312 is connected to the adjustable shells 132, and the other end of the reset spring 312 is connected to the adjustment part 3111.

Referring to FIGS. 4 and 5, the adjustment component 31 further includes two fixed rods 313 and two fixed springs 314. The two fixed rods 313 slid along the axial direction and cooperate with the adjustable shells 132. One end of the two fixed rods 313 close to the adjustment slider 311 abuts against the inclined part 3112, so that when the adjustment slider 311 is slid towards a direction of the central rod 12, the inclined part 3112 pushes the two fixed rods 313 to slide away from the adjustable shells 132 in the axial direction until they are respectively inserted into the two dumbbell holes of the corresponding dumbbell pieces 2, so that the dumbbell pieces 2 are cumulatively installed in the dumbbell body 1 and lifted together with the dumbbell body 1. One end of the two fixed springs 314 is connected to the adjustable shells 132, and the other end of the two fixed springs 314 is respectively connected to the two fixed rods 313, so that when the inclined part 3112 is slid away from the fixed rods 313, the fixed spring 314 pushes the fixed rods 313 to reset. Thus, the fixed rod 313 is detached from the dumbbell hole, and the corresponding dumbbell piece 2 is disconnected from the dumbbell body 1.

Figure 6:
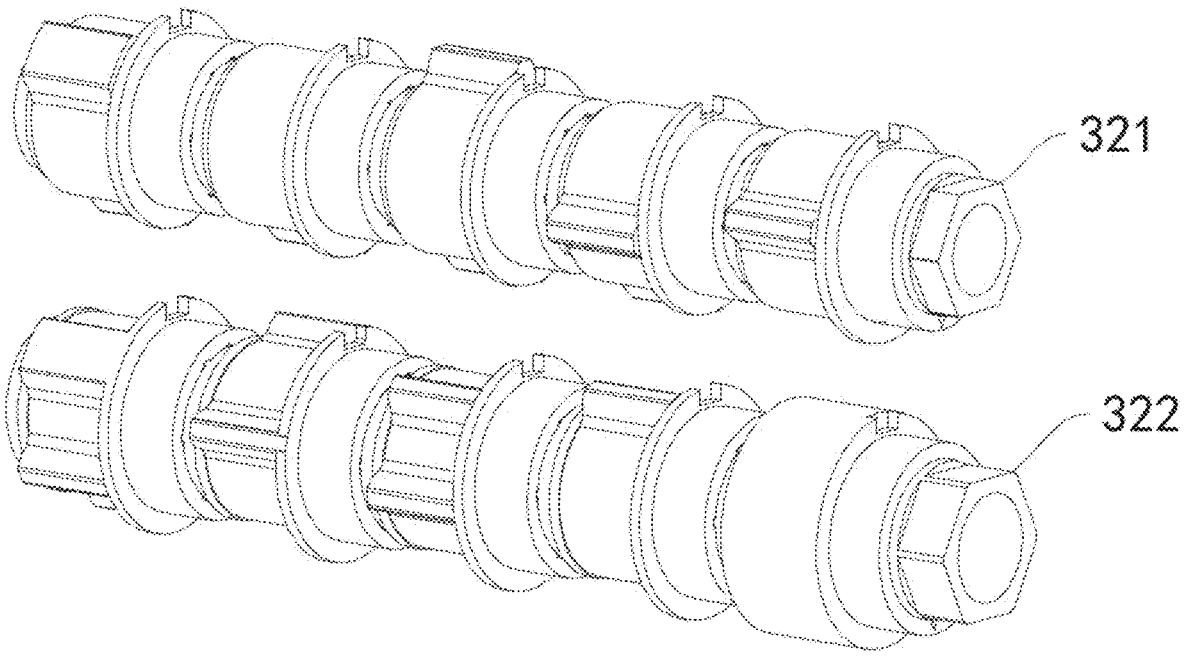
FIG. 6 is a schematic structural diagram of a driving component in the embodiment of the present disclosure.

Referring to FIGS. 4, 5, and 6, the adjustment mechanism 3 further includes a driving component 32, and the driving component 32 includes a first driving shaft 321. The first driving shaft 321 includes a plurality of first shaft body parts 3211, and the first shaft body parts 3211 are composed of the first shaft body parts that are connected end-to-end. The number of the first shaft body parts 3211 corresponds to the number of the adjustable shells 132. The first shaft body parts 3211 are rotatably provided on the adjustable shells 132 and are located at a top of the adjustment slider 311. A plurality of first adjustment blocks 32111 are fixedly provided on an outer peripheral surface of each of the first shaft body parts 3211. The number and position of the first adjustment blocks 32111 provided on the outer peripheral surface of each of the first shaft body parts 3211 are different. The top of the adjustment slider 311 is fixedly provided with a first abutting block 3113 configured to abut against the first adjustment block 32111.

Referring to FIGS. 4, 5, and 6, the driving component 32 further includes a second driving shaft 322, and the second driving shaft 322 includes a plurality of second shaft body parts 3221. The second driving shafts 322 are composed of second shaft body parts 3221 that are connected end-to-end, and the number of the second shaft body parts 3221 corresponds to the number of the adjustable shells 132. The second shaft body parts 3221 are rotatably provided on the adjustable shell 132, and a plurality of second adjusting blocks 32211 are fixedly provided on an outer peripheral surface of each of the second shaft body parts 3221. The number and position of the second adjusting blocks 32211 provided on the outer peripheral surface of each of the second shaft body parts 3221 are different. The first shaft body part 3211 and the second shaft body part 3221 are provided on the same inner part of the adjustable shell 132. The number of the first adjustment blocks 32111 provided in the first shaft body part 3211 is different from the number of the second adjustment blocks 32211 provided in the second shaft body part 3221, and the position of the first adjustment block 32111 provided on the first shaft body part 3211 is different from the position of the second adjustment block 32211 provided on the second shaft body part 3221. The adjustment slider 311 is provided with an adjustment hole 3114 that is penetrated, and the second shaft part 3221 is provided with an adjustment hole 3114 that is penetrated. The adjustment hole 3114 is in the shape of elliptical, so that when the adjustment slider 311 is slid in the radial direction, it is not easy to abut against the second shaft body part 3221. A hole wall of the adjustment hole 3114 is fixedly provided with a second abutting block 3115 configured to abut against the second adjustment block 32211.

When the adjustment slider 311 is slid in a direction close to the fixed rod 313, any first adjustment block 32111 is rotated to abut against the first abutting block 3113, or any second adjustment block 32211 is rotated to abut against the second abutting block 3115, so that both the first shaft body part 3211 and the second shaft part 3221 can achieve the same driving of the adjustment slider 311. Therefore, when the first and second driving shafts 321 and 322 are rotated, the arrangement of driving for each adjustment component 31 is more diverse. Even when the driving component 32 is driven, it can drive any one set of adjustment components 31 of each adjustment component 31, and can drive any two sets of adjustment components 31 at different positions of each adjustment component 31. Thus, the dumbbell body 1 has a plurality of ways to accumulate the dumbbell pieces 2, rendering it possible to adjust the weight of the dumbbell in various ways.

One end of the first shaft body part 3211 is fixedly provided with a plurality of first connection protrusions, and the other end of the first shaft body part 3211 is provided with a plurality of first connection recesses. When the first shaft body parts 3211 are connected end-to-end, each first connection protrusion is inserted and clamped into each first connection recess. In addition, the number and position of each first connection protrusion provided in each of the first shaft body parts 3211 are different, so that the first driving shaft 321 composed of the first shaft body part 3211 has uniqueness, that is, only in a fixed and unique order can it be connected end-to-end to form the first driving shaft 321. One end of the second shaft body 3221 is fixedly provided with a plurality of second connection protrusions, and the other end of the second shaft body 3221 is provided with a plurality of second connection recesses, and when the second shaft parts 3221 are connected end-to-end, each second connection protrusion is inserted and clamped into each second connection recess. In addition, the number and position of each second connection protrusion provided on each of the second shaft body parts 3221 are different, which renders the second driving shaft 322 composed of the second shaft body 3221 to be unique, that is, only in a fixed and unique order can it be connected end-to-end to form the second driving shaft 322.

Referring to FIG. 4, the adjustment mechanism 3 further includes a linkage component 33, the linkage component 33 includes a driving gear 331 and a driven gear 332. One end of the driving gear 331 is coaxially fixed with one end of the grip rod 11, and the other end of the driving gear 331 is coaxially fixed with the second driving shaft 322. The driving gear 331 is located inside the main body shell 131, and the driven gear 332 is coaxially fixed with the first driving shaft 321; the driven gear 332 is located inside the main body shell 131. The driving gear 331 meshes with the driven gear 332, so that when the grip rod 11 is rotated relative to the center rod 12, the grip rod 11 drives the driving gear 331 to rotate, the driving gear 331 drives the first driving shaft 321 to rotate, and the driven gear 332 drives the second driving shaft 322 to rotate synchronously in an opposite direction, thereby driving each set of adjustment components 31.

Figure 7:
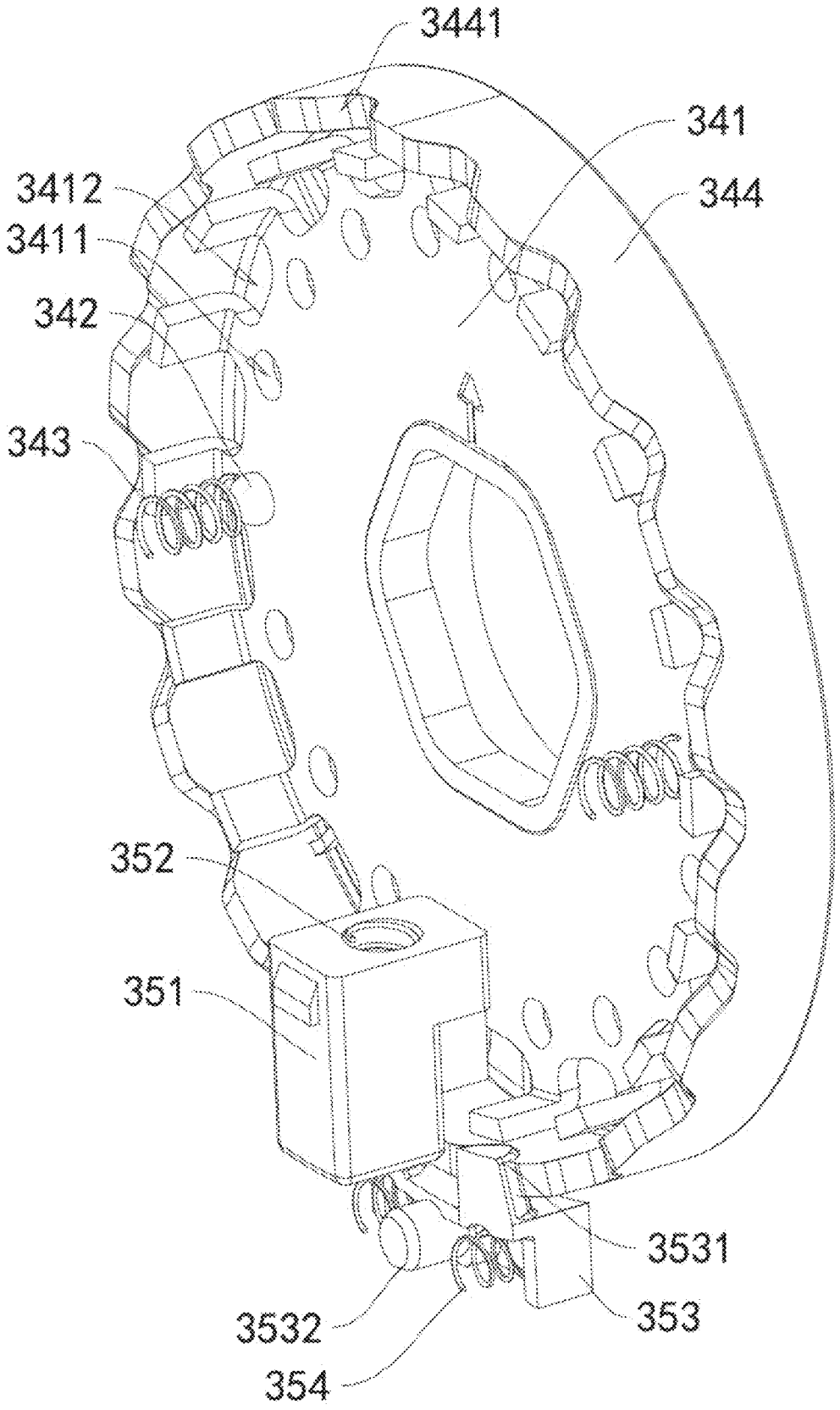
FIG. 7 is a schematic structural diagram of a shifting component in the embodiment of the present disclosure.

Referring to FIGS. 4 and 7, the adjustment mechanism 3 further includes a shifting component 34. The shifting component 34 includes a shifting wheel 341, two shift balls 342, and two shift springs 343. The shifting wheel 341 is coaxially fixed at one end of the grip rod 11, and the shifting wheel 341 is located inside the main body shell 131. The two shift balls 342 are slid and cooperated with the main body shell 131 in the axial direction. The two shift balls 342 are evenly distributed around an axis of the main body shell 131. The shifting wheel 341 is provided with a plurality of shifting holes 3411 configured to clamp and cooperate with the shift balls 342. The shifting holes 3411 are evenly distributed around an axis of the shifting wheel 341. One end of the two shift springs 343 is connected to the main body shell 131, and the other end of the two shift springs 343 is connected to the two shift balls 342.

Thus, a weight adjustment of the adjustable dumbbell is carried out. When the grip rod 11 is rotated relative to the center rod 12, it drives the shifting wheel 341 to rotate, causing the two shift balls 342 to be detached from one shifting hole 3411 and pass through the other shifting hole 3411. Through a repeated detachment of the two shift balls 342 and subsequent passing through the shifting hole 3411, the weight adjustment of the adjustable dumbbell can be accompanied by corresponding sounds, indicating that the adjustable dumbbell has been adjusted to different weights.

Referring to FIGS. 4 and 7, the shifting component 34 further includes a scale wheel 344, and the scale wheel 344 is rotatably provided on the main body shell 131 and fixed coaxially with the grip rod 11. An outer peripheral surface of the scale wheel 344 is provided with a plurality of weight scales (not shown in the figure), and the weight scales are evenly distributed around an axis of the scale wheel 344. The main body shell 131 is provided with a weight hole 1311 that is penetrated. The weight scale directly opposite the weight hole 1311 is the weight of the dumbbell, so that when the grip rod 11 and the center rod 12 are rotated relative to each other, the scale wheel 344 and the main body shell 131 are rotated relative to each other, thereby changing the weight scale directly facing the weight hole 1311. This helps a user intuitively observe the weight changes of the adjustable dumbbell, rendering it easier for him to adjust to a required use weight.

Referring to FIGS. 4 and 7, the adjustment mechanism 3 further includes a locking component 35. The locking component 35 includes a locking slider 351 and a locking spring 352. The locking slider 351 is slid radially and is fitted with the main body shell 131. The shifting wheel 341 is provided with a plurality of locking grooves 3412 configured to clamp and fix with the locking slider 351. Each locking groove 3412 is arranged to pass through two sides in the radial direction. The locking grooves 3412 are evenly distributed around the axis of the shifting wheel 341. One end of the locking spring 352 is connected to the locking slider 351, and the other end of the locking spring 352 is connected to the main body shell 131. When the locking component 35 is locked, the locking slider 351 is inserted, clamped and fixed in any locking groove 3412. When the locking slider 351 is slid towards the center of the shifting wheel 341 until it disengages from the locking groove 3412 and is fixed in place, the locking component 35 is unlocked. At this time, the shifting wheel 341 and the main body shell 131 can rotate relative to each other, Thus, the grip rod 11 and the center rod 12 can rotate relative to each other.

Referring to FIGS. 4 and 7, the locking component 35 further includes a safety slider 353 and a safety spring 354. The safety slider 353 is slid in the axial direction and is fitted with the main body shell 131. The safety slider 353 is fixedly connected to two first safety blocks 3531 in the radial direction. The scale wheel 344 is provided with a plurality of safety slots 3441 configured to clamp and fix with the first safety blocks 3531. The safety slots 3441 are evenly distributed around the axis of the scale wheel 344. One end of the safety spring 354 is connected to the safety slider 353, and the other end of the safety spring 354 is connected to the main body shell 131. The safety slider 353 is fixedly connected to a second safety block 3532 in the axial direction. When the scale wheel 344 is rotated relative to the main body shell 131, the two first safety blocks 3531 continuously follow the rotation of the scale wheel 344, detached from a cooperation with the safety slot 3441 and subsequently cooperated with another safety slot 3441, this process is continuously carried out, until the scale wheel 344 and the main body shell 131 stop rotating relative to each other, the safety slider 353 slides back and forth in the axial direction, thereby driving the second safety block 3532 to slide back and forth in the axial direction. In addition, when the locking slider 351 is facing any locking groove 3412, the two first safety blocks 3531 are respectively inserted into any two adjacent safety slots 3441. When the locking slider 351 is facing a position between the two locking grooves 3412, the two first safety blocks 3531 are disengaged from a locking fitted with the safety slot 3441. At this time, a straight-line distance between the second safety block 3532 and the scale wheel 344 is the farthest.

The implementation principle of the adjustable dumbbell in this disclosure is as follows: when weight adjustment is required for adjusting the dumbbell, the locking component 35 is unlocked, and the grip rod 11 is rotated relative to the center rod 12, thereby driving the driving gear 331 to rotate. Then, through the driving gear 331 and the driven gear 332, the first driving shaft 321 and the second driving shaft 322 are simultaneously driven, thereby driving the adjustment mechanism 3 to drive each adjustment component 31, so that a part of the adjustment slider 311 is slid in the direction close to the fixed rods 313, thereby pushing the fixed rods 313 to pass through the dumbbell hole, so that the corresponding dumbbell piece 2 accumulates on the dumbbell body 1, and the other part of the adjustment slider 311 is slid away from the fixed rods 313, thereby causing the fixed rods 313 to detach from the dumbbell hole, thereby causing the dumbbell piece 2 to detach from the dumbbell body 1. Thus, the weight adjustment of the dumbbell can be quickly completed, thereby improving a problem that although the weight adjustment of the dumbbell is achieved, manually disassembling and adding or removing the dumbbell pieces to adjust the weight is laborious and requires manual calculation of the adjusted weight. This further leads to low efficiency in adjusting the weight of the dumbbells, rendering it difficult to frequently adjust the weight of the dumbbells, thereby affecting the exercise effectiveness of using the dumbbells.

As mentioned above, when the grip rod can be rotated relative to the center rod, the locking component needs to be unlocked. When the locking component is unlocked, the locking slider needs to slide towards the center position of the shifting wheel until it disengages from the locking groove.

Figure 8:
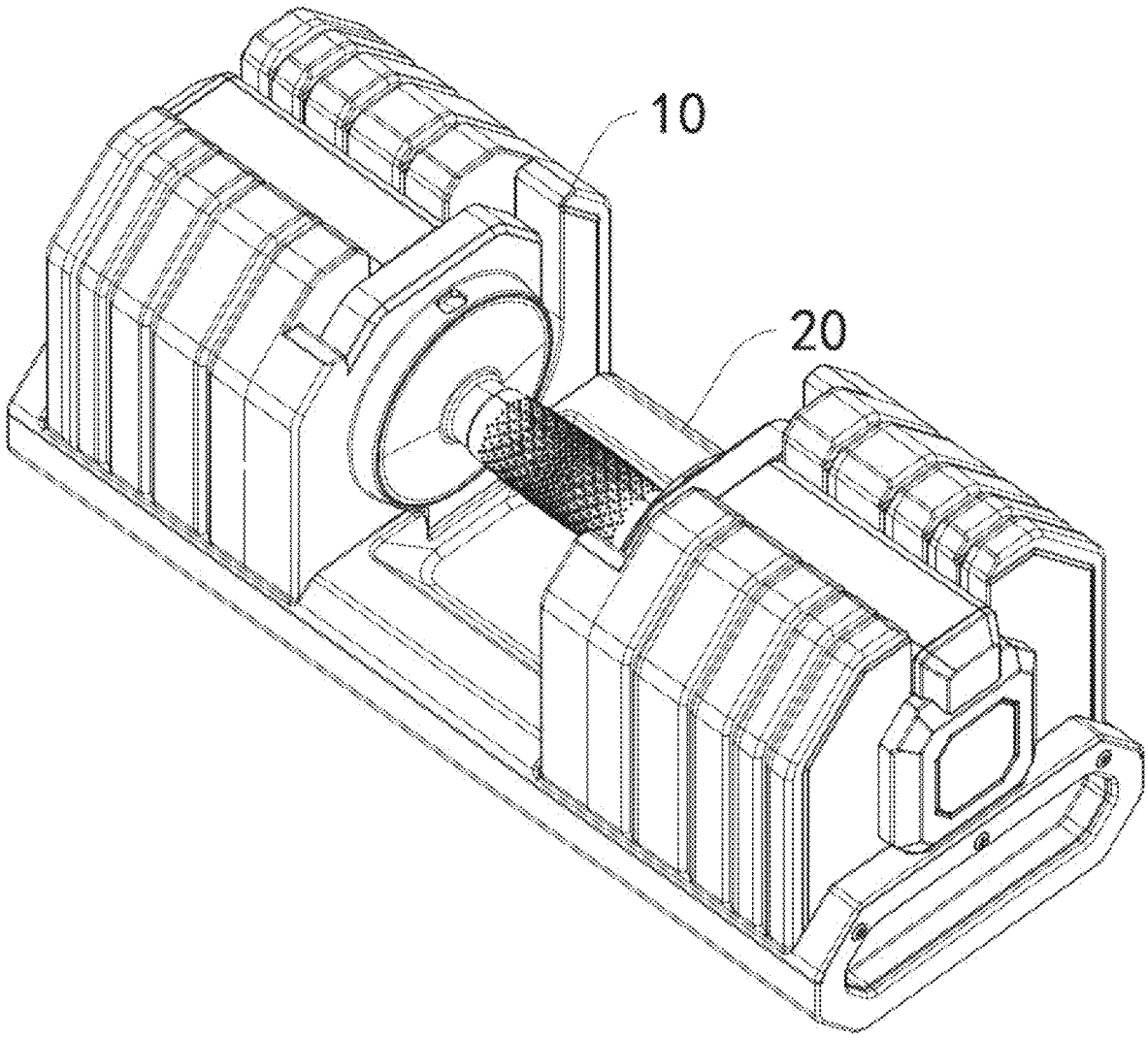
FIG. 8 is a schematic structural diagram of a dumbbell kit.
Figure 9:
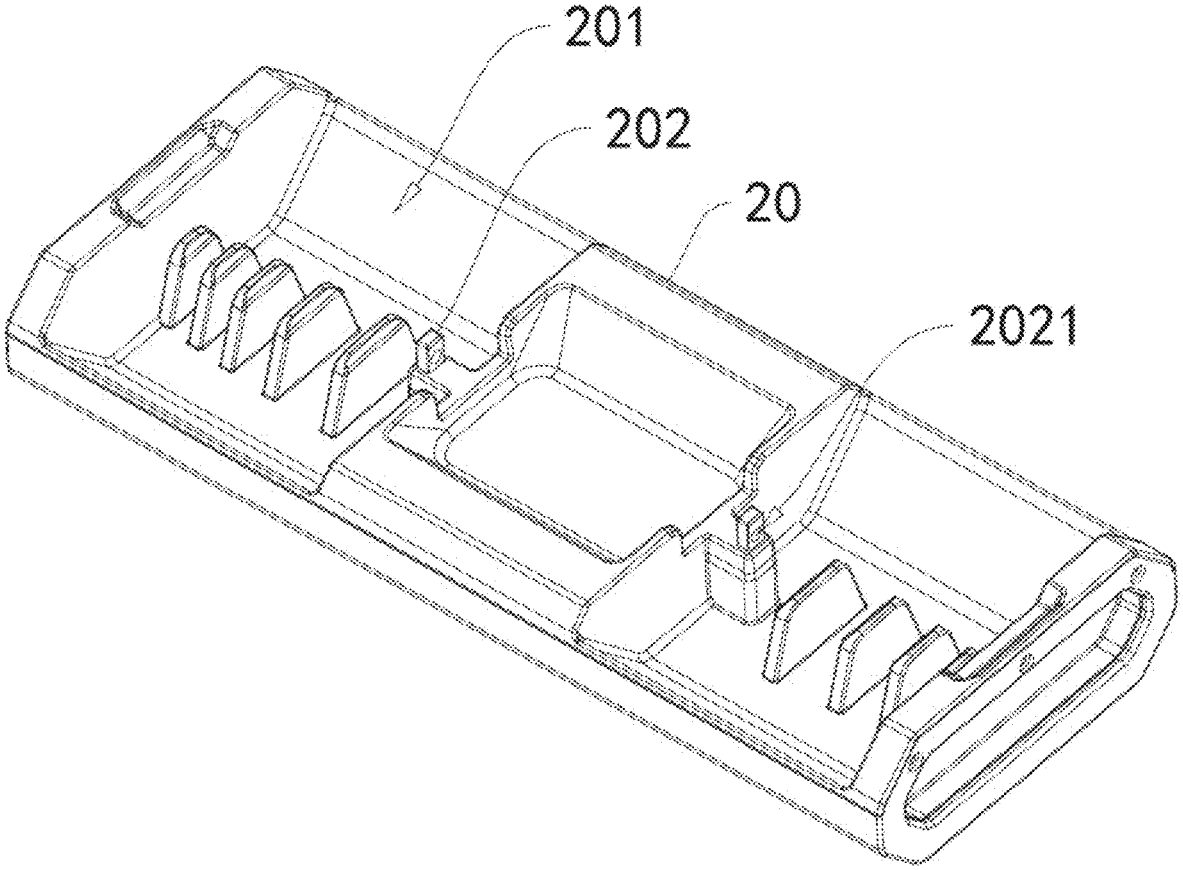
FIG. 9 is a schematic structural diagram of a dumbbell seat.

Referring to FIGS. 8 and 9, an embodiment further provides a dumbbell kit including the adjustable dumbbell 10 and a dumbbell seat 20 configured to place the adjustable dumbbell 10. The dumbbell seat 20 is provided with a placement groove 201, and the placement groove 201 is provided with two unlocking blocks 202 configured to unlock the locking component 35. When the adjustable dumbbell 10 is placed on the dumbbell seat 20, the two unlocking blocks 202 are respectively abutted against the two locking sliders 351 and push the locking slider 351 to disengage from the locking groove 3412, thereby unlocking the locking component 35.

Referring to FIGS. 8 and 9, the unlocking block 202 is provided with a safety hole 2021 configured to cooperate with the second safety block 3532. When the locking slider 351 is directly facing a position between two adjacent locking grooves 3412, the second safety block 3532 is inserted into the safety hole 2021. At this time, the adjustable dumbbell 10 is connected to the dumbbell seat 20 until the locking slider 351 is directly facing any locking groove 3412. The second safety block 3532 disengages from the safety hole 2021, and the adjustable dumbbell 10 is disconnected from the dumbbell seat 20. This renders it difficult for the adjustable dumbbell 10 to be detached from the dumbbell seat 20 when the locking component 35 is not fully locked, thereby rendering the weight adjustment of the adjustable dumbbell 10 safer.

The above are the preferred embodiments of the present disclosure and do not limit the protection scope of the present disclosure. Therefore, any equivalent changes made according to the structure, shape, and principle of the present disclosure should be included in the protection scope of the present disclosure.

What is claimed is:

1. An adjustable dumbbell, comprising:

a dumbbell body, wherein the dumbbell body comprises a grip rod, a center rod provided at a center position of the grip rod, two sets of shell components respectively provided at two ends of the grip rod, and one or more adjustable shells fixedly connected to the center rod, wherein the shell components comprise a main body shell that is fixedly connected to the center rod;

dumbbell pieces that are accumulatively installed at two ends of the dumbbell body, the dumbbell pieces correspond to the one or more adjustable shells, and the dumbbell pieces are provided with dumbbell holes; and adjustment mechanisms that are respectively provided at two ends of the dumbbell body, wherein the grip rod is rotated relative to the central rod, the adjustment mechanisms comprise one or more sets of adjustment components and one or more fixed rods; a number of the adjustment components corresponds to a number of the one or more adjustable shells, each set of the adjustment components is respectively provided in each of the one or more adjustable shells, the adjustment components comprise an adjustment slider, the adjustment slider is slid radially and fit inside the one or more adjustable shells, the fixed rod is slid axially and fit inside the one or more adjustable shells, wherein the fixed rod is in contact and fitted with the adjustment slider;

when the adjustment slider is slid towards the fixed rod, the fixed rod is slid towards the dumbbell pieces and pass through the dumbbell holes, so that the dumbbell pieces are accumulated on the dumbbell body;

wherein the adjusting component further comprises a reset spring and a fixed spring, one end of the reset spring is connected to the one or more adjustable shells and an other end of the reset spring is connected to the adjustment slider;

a number of the fixed spring corresponds to a number of the fixed rod, one end of the fixed spring is connected to the one or more adjustable shells and an other end of the fixed spring is connected to the fixed rod.

2. The adjustable dumbbell according to claim 1, wherein the adjustment mechanisms further comprise a driving component; the driving component comprises a first driving shaft, the first driving shaft comprises one or more first shaft body parts, the first driving shaft is composed of the one or more first shaft body parts that are connected end-to-end, a number of one or more first shaft body parts corresponds to the number of the one or more adjustable shells, and the one or more first shaft body parts are rotatably provided on the one or more adjustable shells;

one or more first adjustment blocks are fixedly provided on an outer peripheral surface of each of the one or more first shaft body parts, number and position of the one or more first adjustment blocks provided on the outer peripheral surface of each of the one or more first shaft body parts are different;

the adjustment slider is fixedly provided with a first abutting block configured to abut against the one or more first adjustment blocks; when the adjustment slider is slid towards the fixed rod, any of the one or more first adjustment blocks is rotated to abut against the first abutting block.

3. The adjustable dumbbell according to claim 2, wherein the driving component further comprises a second driving shaft, the second driving shaft comprises one or more second shaft body parts, the second driving shaft is composed of the second shaft body parts that are connected end-to-end, a number of the second shaft body parts corresponds to the number of the one or more adjustable shells, and the second shaft body parts are rotatably provided in the one or more adjustable shells;

one or more second adjustment blocks are fixedly provided on an outer peripheral surface of each of the second shaft body parts; number and position of the second adjustment blocks provided on the outer peripheral surface of each of the second shaft body parts are different;

the one or more first shaft body parts and the second shaft body part are provided in the same one or more adjustable shells, the number of the one or more first adjustment blocks provided on the one or more first shaft body parts and the number of the second adjustment blocks provided on the second shaft body part are different, and the position of the one or more first adjustment blocks provided on the one or more first shaft body parts and the position of the second adjustment block provided on the second shaft body part are different;

the adjustment slider is provided with an adjustment hole that runs through the adjustment slider, the second shaft body part passes through the adjustment hole, and a hole wall of the adjustment hole is fixedly provided with a second abutting block configured to abut against the second adjustment block;

when the adjustment slider is slid towards the fixed rod, any of the one or more first adjustment blocks is rotated to abut against the first abutting block, or any of the second adjustment blocks is rotated to abut against the second abutting block.

4. The adjustable dumbbell according to claim 3, wherein the adjustment mechanism further comprises a linkage component, wherein the linkage component comprises a driving gear and a driven gear, the driving gear is coaxially and fixedly connected to the grip rod and is coaxially fixed with the second driving shaft;

the driven gear is fixed coaxially with the first drive shaft; the driving gear meshes with the driven gear.

5. The adjustable dumbbell according to claim 1, wherein the adjustment mechanism further comprises a shifting component, one or more shift balls, and a shift spring; the shifting component comprises a shifting wheel, the shifting wheel is rotatably provided on the main body shell and fixed coaxially with the grip rod;

the shifting wheel is provided with a plurality of shifting holes, the shifting holes are uniformly distributed around an axis of the shifting wheel in a circumferential direction;

the shift ball is slid along an axial direction and is configured to engage with any shifting hole;

the number of the shift spring corresponds to the number of the shift ball, one end of the shift spring is connected to the one or more adjustable shells and an other end of the shift spring is connected to the shift ball;

when adjusting a weight of the dumbbell, the shift ball is disengaged from one shifting hole and passes through another shifting hole.

6. The adjustable dumbbell according to claim 5, wherein the shifting component further comprises a scale wheel, the scale wheel is rotatably provided on the main body shell and fixed coaxially with the grip rod;

an outer peripheral surface of the scale wheel is provided with a plurality of weight scales, the weight scales are uniformly distributed around an axis of the scale wheel in a circumferential direction;

the main body shell is provided with a weight hole, and a weight scale directly opposite the weight hole is a weight of the adjustable dumbbell.

7. The adjustable dumbbell according to claim 6, wherein the adjustment mechanism further comprises a locking component, a locking spring, a safety slider, and a safety spring; the locking component comprises a locking slider, the locking slider is slid radially and fitted with the main body shell, the shifting wheel is provided with a plurality of locking grooves configured to clamp and fix with the locking slider, when the locking component is locked, the locking slider is inserted, clamped and fixed in any locking groove;

one end of the locking spring is connected to the locking slider, and an other end of the locking spring is connected to the main body shell;

the safety slider is slid along an axial direction and fitted with the main body shell; the safety slider is fixedly connected to one or more first safety blocks in a radial direction;

the scale wheel is provided with a plurality of safety slots configured to clamp and fix with the first safety block; the safety slider is fixedly connected to a second safety block along the axial direction;

when the locking component is locked, the first safety block is inserted, clamped and fixed in any of the plurality of safety slots;

one end of the safety spring is connected to the safety slider and an other end of the safety spring is connected to the main body shell.

8. A dumbbell kit comprising the adjustable dumbbell according to claim 1 and a dumbbell seat configured to place the adjustable dumbbell, wherein the dumbbell seat is provided with a placement groove configured to place the adjustable dumbbell, the placement groove is provided with two unlocking blocks configured to unlock a locking component; when the adjustable dumbbell is placed on the dumbbell seat, the two unlocking blocks are respectively abutted against two locking sliders, and push the locking sliders to disengage from locking grooves to achieve an unlocking of the locking component.

9. The dumbbell kit according to claim 8, wherein the unlocking blocks are provided with a safety hole, and when the locking sliders face a position between two adjacent locking grooves, the second safety block is inserted into the safety hole, then the adjustable dumbbell is connected to the dumbbell seat until the locking sliders are directly facing any of the locking grooves, when the second safety block is disengaged from the safety hole, the adjustable dumbbell is disconnected from the dumbbell seat.

* * * * *